US006022153A

United States Patent [19]

Mogi

[11] Patent Number: 6,022,153

[45] Date of Patent: Feb. 8, 2000

[54] METHOD OF REPLENISHING SOLUTION FOR PHOTOSENSITIVE MATERIAL PROCESSOR AND PHOTOSENSITIVE MATERIAL PROCESSOR

[75] Inventor: Fumio Mogi, Kanagawa, Japan

[73] Assignee: Fuji Photo Film Co., Ltd., Kanagawa, Japan

[21] Appl. No.: 09/062,899

[22] Filed: Apr. 21, 1998

Related U.S. Application Data

[62] Division of application No. 08/752,229, Nov. 19, 1996, abandoned.

[30] Foreign Application Priority Data

Nov. 21, 1995 [JP] Japan ..... 7-302721

[51] Int. Cl.[7] ..... G03D 3/02

[52] U.S. Cl. ..... 396/626; 396/578

[58] Field of Search ..... 396/578, 572, 396/571, 626, 636, 641; 430/30, 398–400

[56] References Cited

U.S. PATENT DOCUMENTS

| | | | |
|---|---|---|---|
| 5,124,239 | 6/1992 | Fujita et al. | 430/398 |
| 5,177,521 | 1/1993 | Mogi et al. | 396/626 |
| 5,185,623 | 2/1993 | Mogi | 396/626 |
| 5,206,121 | 4/1993 | Fujita et al. | 430/398 |
| 5,250,396 | 10/1993 | Ueda et al. | 430/398 |
| 5,366,853 | 11/1994 | Yoshimoto | 430/430 |
| 5,400,105 | 3/1995 | Koboshi et al. | 396/626 |
| 5,452,045 | 9/1995 | Koboshi et al. | 396/626 |
| 5,530,511 | 6/1996 | Verlinden et al. | 396/626 |
| 5,619,745 | 4/1997 | Kobayashi | 396/626 |

FOREIGN PATENT DOCUMENTS

| | | | |
|---|---|---|---|
| 41756 | 1/1992 | Japan | G03D 3/06 |
| 5181250 | 7/1993 | Japan | G03D 3/06 |
| 75657 | 1/1995 | Japan | G03D 3/06 |
| 7175194 | 7/1995 | Japan | G03D 3/00 |

*Primary Examiner*—D. Rutledge
*Attorney, Agent, or Firm*—Sughrue, Mion, Zinn, Macpeak & Seas, PLLC

[57] ABSTRACT

A processor for processing a photosensitive material. The processor includes a discharge device for discharging a processing solution stored in a processing tank, a replenishment device for replenishing a replenisher solution to the processing tank, a processing solution acquiring device for acquiring the quantity of the processing solution stored in the processing tank, and a water adding device for adding water to the processing tank. The discharge device is able to measure the processing solution to be discharged, and the replenishment device is able to measure the replenisher solution to be replenished.

13 Claims, 11 Drawing Sheets

METHOD OF REPLENISHING SOLUTION FOR PHOTOSENSITIVE MATERIAL PROCESSOR AND PHOTOSENSITIVE MATERIAL PROCESSOR

This is a divisional of application Ser. No. 08/752,229 filed Nov. 19, 1996 now abandoned.

BACKGROUND OF THE INVENTION

1. Field of the Invention

The present invention relates to a method of replenishing a solution for a photosensitive material processor and a photosensitive material processor capable of stably maintaining the quality of a processing solution.

2. Description of the Related Art

Hitherto, a photosensitive material processor, called a "Mini-Lab", requires replenishment of a processing-solution in a quantity corresponding to the amount of the processed photosensitive material in order to maintain the quality of the processing solution.

When a replenishment solution (a replenishment solvent or a replenishment solute) has been injected into the processing solution, the volume of the processing solution is enlarged and an excessive amount of the processing solution flows over the processing tank. If the processing system is a cascade system, the excess processing solution is cascaded into another processing tank. If the processing tank is structured such that waste water is discharged, the overflow processing solution is discharged into a waste-water tank or a waste-water processing tank.

In a case where the processing solution is replenished in a large quantity and if the photosensitive material is, for each day, processed in a quantity larger than a predetermined quantity, replenishment is performed in a sufficient quantity.

However, the quantity of replenishment has been reduced in recent years such that the amount of replenishment for a unit quantity of each photosensitive material and the amount of the waste water are reduced.

Since the reduction in the amount of replenishment results in the operation for replenishing the solution to the processor and discharging waste water being reduced, the labor for a user and the amount of waste water can be reduced. Therefore, the cost for processing waste water and space for storing waste water can be saved. Since the reduction is a preferred fact for environmental protection, the amount will furthermore be reduced.

However, the reduction in the amount of replenishment encounters a problem in that it is difficult to stably maintain the quality of the processing solution in the processor.

If the amount of replenishment per unit time is too small due to the reduction in the amount of replenishment or if the processed amount of the photosensitive material per day is too small attributable to employment of the small-quantity replenishment method, the processing solution stored in the processing tank of the processor may evaporate and be condensed. If the amount of evaporation is larger than the amount of replenishment, the level of the processing solution in the processing tank is lowered.

The above-mentioned condensation, as has been known, deteriorates the processing performance of the processing solution.

In order to correct the amount of evaporation, some processors developed in recent years are provided with a system for adding water. Although the foregoing method is effective in correcting the amount of evaporation, it is difficult to accurately be correct the amount of evaporation by adding water in a in which uses the processing solution is used in a small quantity or which uses the small replenishment method. The foregoing method encounters a difficulty in stably maintaining the concentration of the stored processing solution because the concentration of the same is considerably affected by condensation or dilution attributable to the inadequate quantity of the added solution in a case where the quantity of a replenisher solution (the quantity of chemicals) is small.

As a method of correcting the amount of the evaporated solution, a method has been suggested in which the amount to be processed corresponding to the environment of the processor is previously measured and water is added in accordance with obtained data (see Japanese Patent Application Laid-Open (JP-A) No. 4-1756 and Japanese Patent Application Laid-Open (JP-A) No. 5-181250). Another method has been suggested in which detection of lowering of the level of the processing solution in the processor occurring due to evaporation from the processing tank is performed and water is added (see Japanese Patent Application Laid-Open (JP-A) No. 7-5657).

In the latter method, in which the level is detected in accordance with a total result of replenishment, carry over by which the processing solution is carried from another tank when replenishment is performed or when the photosensitive material is carried, evaporation and the like, a critical error cannot be prevented. Thus, this method cannot be adapted to the small replenishment method.

Although the former method, in which the correction is performed in accordance with the previous measurement, is able to accurately correct the level of the solution, error sometimes takes place between the actual data and the previous value.

As described above, the amount of evaporation in the processing tank cannot easily and accurately be detected.

SUMMARY OF THE INVENTION

In view of the foregoing, an object of the present invention is to provide a method of replenishing a solution to a photosensitive material processor which is capable of stably maintaining the performance of the processing solution even if it is adapted to a small replenishment method or a small processing amount method.

Hitherto, waste water and cascade have been performed by means of overflow. If no evaporation takes place and the tank is in a fully-filled state, the solution in a quantity which is the same as the replenished quantity is discharged or cascaded. However, evaporation or carry over results in the fully-filled state not always being realized. Therefore, the same quantity as the replenished quantity is not discharged. If the waste water is discharged or cascaded in a predetermined quantity when replenishment is performed, the components in the stored processing solution can be maintained. If water can accurately be added in a quantity corresponding to the amount of evaporation, a constant concentration of the processing solution can be maintained. That is, it can be understood that control of the amount of replenishment, that of evaporation, that of discharge, that of carry over and that of carry in is an important fact to maintain the performance of the processing solution.

In a processing tank in which the amount of the carry over and that of the carry in are substantially the same, the amount of replenishment and that of discharge are substantially the same. If the solution level is lowered after the solution has been discharged in a quantity which is the same as that of the replenishment, the quantity corresponds to the amount of evaporation. In a processing tank, such as the development tank, in which the amount of carry over and that of the carry in are not the same when the photosensitive material is processed (because the development tank is free from carry in), the amount of replenishment and that of discharge do not coincide with each other and thus the waste water is smaller by the quantity corresponding to the amount of the carry over. Therefore, if the solution level is lowered in a case where the quantity obtained by subtracting the amount of the carry over from the amount of replenishment is discharged as the amount of discharge, the quantity of lowering corresponds to the amount of evaporation.

By simultaneously controlling the amount of discharge and that of the replenishment, the material balance of the processing solution can easily be controlled.

In view of the foregoing, according to one aspect of the present invention, there is provided a method of replenishing a solution to a photosensitive material processor for processing a photosensitive material, comprising the steps of: (a) performing a step including a step for replenishing a replenisher solution in a first predetermined quantity to a processing tank and a step for discharging, in a second predetermined quantity, a processing solution stored in the processing tank; and (b) adding water until the quantity of the processing solution in the processing tank is enlarged to a predetermined quantity.

The operation of the method of replenishing a solution to a photosensitive material processor according to the first aspect will now be described.

When the photosensitive material has been processed in the processing tank, the replenisher solution in the first predetermined quantity is replenished to the processing tank, and the processing solution in the second predetermined quantity is discharged from the processing tank. The order of performing the discharge of the processing solution and the replenishment of the replenisher solution is not limited and they may be performed simultaneously.

After the replenishment step and the discharge step have been completed, water is added to a reference level for the processing solution in the processing tank. As a result, the quality (the concentration) of the processing solution in the processing tank can be maintained.

That is, the processing solution stored in the processing tank to a predetermined reference level is evaporated as the time elapses and therefore the level of the processing solution is lowered. Hence, after the photosensitive material has been processed and the discharge of the processing solution and replenishment of the replenisher solution have been completed, the solution level is made to be lower than the reference level by a degree corresponding to the amount of evaporation. Since the amount of lowering from the reference level is the amount of evaporation, addition of water compensates the evaporated water. Thus, the quality (the concentration) of the processing solution can be maintained.

In a processing tank in which the amount of carry over of the processing solution carried over by the photosensitive material from the processing tank and the amount of carry in of the processing solution carried in by the photosensitive material into the processing tank coincide with each other, the amount of replenishment and that of the discharge are made to be the same. If the solution level is lower than the reference level in the case where the amount which is the same as the amount of replenishment has been discharged, the quantity corresponds to the amount of evaporation. Therefore, water is required to be added to raise the level to the reference level.

In a case of a processing tank, such as the development tank in which the amount of carry over and that of carry in do not coincide with each other when the photosensitive material is processed, a quantity obtained by subtracting the amount of carry over from the amount of replenishment is discharged as a predetermined amount of discharge. If the solution level is lowered, the quantity of lowering corresponds to the amount of evaporation. Therefore, water is required to be added to raise the solution level to the reference level.

The discharge of the processing solution and the evaporation of the replenisher solution are performed when the photosensitive material is not being processed. In another case, they are performed when the photosensitive material is being processed. In the case where the discharge and replenishment are performed while the photosensitive material is being processed, it is preferable that the replenishment and discharge be performed simultaneously. That is, if replenishment and discharge are performed simultaneously, the level of the processing solution in the processing tank is not changed and therefore the time in which the photosensitive material is processed in the solution can be maintained to a constant length. As described above, the performance of the processing solution can stably be maintained even with a small replenishment method or a small amount of process.

According to a second aspect of the present invention, there is provided a method of replenishing a solution to a photosensitive material processor according to the first aspect, wherein discharge of the processing solution in the second predetermined quantity and replenishment of the replenisher solution in the first predetermined quantity correspond to the quantity of the photosensitive material to be processed.

According to the second aspect, the discharge of the processing solution in the second predetermined quantity and the replenishment of the replenisher solution in the first predetermined quantity are performed to correspond to the quantity of the photosensitive material. Therefore, the quality of the processing solution can be maintained within a predetermined range.

According to a third aspect of the present invention, there is provided a photosensitive material processor, comprising: discharge means for discharging a processing solution stored in a processing tank; replenishment means for replenishing-a replenisher solution to the processing tank; processing solution amount acquiring means for acquiring the quantity of the processing solution stored in the processing tank; and water adding means for adding water to the processing tank, wherein the discharge means is able to measure the processing solution to be discharged, and the replenishment means is able to measure the replenisher solution to be replenished.

In the photosensitive material processor according to the foregoing aspect, after the photosensitive material has been processed in the processing tank, the discharge means is able to measure the amount of discharge and the replenishment means is able to measure the amount of replenishment. Therefore, a predetermined quantity of the processing solution can be discharged from the processing tank by the discharge means, and a predetermined quantity of replenisher solution can be replenished into the processing tank by the replenishment means. Note that either of the discharge and replenishment may be performed first. They may also be performed simultaneously.

After the discharge of the processing solution and the replenishment of the replenisher solution have been completed, water is added to realize the predetermined amount for the processing solution in the processing tank by the water adding means. Note that the reference amount of processing solution in the processing tank can be recognized by the processing solution amount acquiring means. As a result, the quality (the concentration) of the processing solution in the processing tank can be maintained.

In a processing tank in which the amount of carry over and that of carry in are substantially the same, the amount of replenishment and that of discharge are made to be the same. If the solution level of the processing solution in the processing tank is lower than the reference level, the quantity corresponds to the amount of evaporation. Therefore, water is required to be added to raise the level to the reference level.

In a processing tank, such as the development tank, in which the amount of carry over and that of carry in do not coincide with each other when the photosensitive material is processed, a quantity obtained by subtracting the amount of carry over from the amount of replenishment is discharged as a predetermined amount of discharge. If the solution level is lowered afterwards, the amount corresponds to the amount of evaporation. Therefore, water is required to be added to raise the level to the reference level.

That is, the processing solution stored in the processing tank to a predetermined reference level is evaporated as the time elapses and therefore the level of the processing solution is lowered. Therefore, after the photosensitive material has been processed and the discharge of the processing solution and replenishment of the replenisher solution have been completed, the solution level is lower than the reference level by a degree corresponding to the amount of evaporation. Since the amount of lowering from the reference level is the amount of evaporation, addition of water compensates the evaporated water. Thus, the quality (the concentration) of the processing solution can be maintained.

It is preferable that each of the discharge means and replenishment means capable of respectively measuring the quantities be a proportioning pump capable of measuring the amount of discharge and that of replenishment. For example, a bellows pump, a cylinder pump, a gear pump, a rotary pump, a diaphragm pump or a tube-type pump may be employed. Any pump having a measuring means capable of measuring the amount of the discharge may be employed. For example, a pump having a discharging means capable of measuring the discharge the pump including a flow meter for measuring the amount of discharge or which is structured to measure the discharge time or to detect the solution level in the processing tank, could be used. In place of the pump, a discharge valve having means capable of measuring the amount of the processing solution may be employed. An electromagnetic valve capable of automatically opening and closing may preferably be employed as the discharge valve.

The solution level sensor for recognizing the amount of the processing solution stored in the processing tank may be a structure comprising a limit switch, a level sensor or a pressure sensor. It is preferable that the structure be formed such that the amount of the processing solution can be recognized in accordance with data obtained by previous measurement in order to make the output from the level sensor or the pressure sensor to correspond to the amount of the processing solution stored in the processing tank. Specifically, the storage portion of the control unit for controlling the operation of the photosensitive material processor stores a lookup table indicating the relationship between the solution level of the processing solution in the processing tank, which has been obtained, and the amount of the processing solution in the processing tank. In accordance with a result of detection performed by the sensor, the amount of the processing solution in the processing tank may be obtained from the lookup table.

As described above, according to this aspect of the present invention, the amount of solution discharged from the processing tank and the amount of replenishment replenished into the processing tank can accurately be obtained. Therefore, reduction in the processing solution attributable to evaporation can furthermore accurately be recognized and therefore water can be added with excellent accuracy. Also according to this embodiment, stable quality of the processing solution can be maintained even with a small replenishment method or a processing machine arranged to process films in a small quantity. Since the amount of replenishment and that of discharge are measured and the amount of the processing solution in the processing tank is acquired to compensate the amount of evaporation of the processing solution, the solution (by adding water) level of the processing solution in the processing tank can be maintained at a constant level after water has been added. If the solution level is higher or lower than a usual level after water has been added, the replenishment means or the discharge means, such as the pump, sometimes has a defect. According to this aspect of the present invention, such a defect can immediately be detected. In this case, it is preferable that an alarm unit be provided. As a result, a countermeasure against the defect of the processing apparatus can quickly be taken so that the quality of the processing solution in the processing tank is always maintained satisfactorily. If the solution level after water has been added rises, the amount of discharge is too small or the amount of replenishment is too large. If the solution level after water has been added lowers, the amount of replenishment is too small or the amount of discharge is too large. If the replenishment means or the discharge means, such as the pump, is free from a defect, an estimation can be performed that the cause is carry over or carry in attributable to change in the squeezing performance. As described above, a problem can be detected before the processing solution in the processing tank encounters degradation and the processing performance deteriorates.

According to a fourth aspect of the present invention, there is provided a photosensitive material processor according to the third aspect, wherein the discharge means and the replenishment means are structured to be operated in synchronization with each other.

Since the photosensitive material processor according to the foregoing aspect has the structure such that the discharge means and the replenishment means are arranged to be operated in synchronization with each other, discharge of the processing solution and replenishment of the replenisher solution can efficiently and accurately be performed.

As a physical method for realizing the synchronized operation, a structure may be employed in which a multi-pump is employed to simultaneously perform replenishment and discharge by one power source. Since the multi-pump is able to perform the replenishment and the discharge in synchronization with each other, an error between the two operations can be prevented satisfactorily. Since only one motor or the like is required, the pump can be manufactured with a low cost.

As an electric synchronization method, individual pumps are employed which are operated by a common power supply.

Since the first tank (the development tank) of the photosensitive material processor is free from carry in, the amount of the discharge is a value obtained by subtracting the amount of carry over from the amount of replenishment. Each of the second and following tanks discharges a quantity which is the same as the quantity of replenishment on an assumption that the amount of carry over and that of carry in are the same. Since discharge and replenishment closely relates to each other as described above, it is preferable that the discharge means and the replenishment means are arranged to be operated in synchronization with each other by a physical or electrical means in order to efficiently measure and discharge the solution.

According to a fifth aspect of the present invention, there is provided a photosensitive material processor according to the third or fourth aspect, wherein the processing solution amount acquiring means has a solution level sensor for detecting the level of the processing solution in the processing tank, storage means for storing the relationship between the solution level in the processing tank and the amount of the stored processing solution, and calculating means for calculating the amount of the processing solution in the processing tank in accordance with the solution level detected by the solution level sensor and the relationship stored in the storage means, wherein the area of opening of the cross section of the processing tank in the horizontal direction in a vertical range in which the solution level of the processing solution must be detected by the solution level sensor is smaller than the area of opening of the cross section of the processing tank in the horizontal direction below the vertical range.

Since the photosensitive material processor according to the fifth aspect of the present invention has the structure such that the area of opening of the cross section of the processing tank in the horizontal direction in a vertical range in which the solution level of the processing solution must be detected by the solution level sensor is smaller than area of opening of the cross section of the processing tank in the horizontal direction below the vertical range, change in the solution level with respect to change in the amount of the processing solution in the processing tank can be enlarged. Thus, the detection accuracy can be improved.

It is preferable that the amount of the processing solution stored in the processing tank be accurately recognized as much as possible. In order to accurately recognize the same, the processing tank is structured such that the enlargement of the level change per unit volume enables the sensitivity of the level sensor or the pressure sensor to be improved.

As a structure for improving the sensitivity in detecting the change in the volume of the processing solution, an immersed plate may be secured in the processing tank to enlarge the level change per unit volume at the surface of the solution. The volume of a processing rack (which is a conveyance unit immersed in the processing solution and comprising rollers for conveying the photosensitive material and plates for supporting the rollers) in a portion which is in contact with the level of the processing solution may be enlarged to enlarge the level change per unit volume at the level of the processing solution.

It is preferable that the level change per unit volume be 1 mm or greater with respect to 10 milliliters, more preferably 1 mm or more with respect to 5 milliliters. Further preferably, a level change of 1 mm or more is realized with respect to 1 milliliters.

For example, CN-16L, which is the film processing standard of Fuji Film, has an arrangement such that the amount of replenishment of bleacher is determined to be 5 milliliters for one 135-size film having 24 frames. Therefore, if the solution level is not changed by 1 mm or greater with respect to 10 milliliters (in this case, a change of 0.5 mm takes place), the solution level cannot accurately be detected attributable to the replenishment. In this case, a costly sensor is required.

As described above, the immersed plate or a partial enlargement of the processing rack is employed to reduce the quantity of the solution at the level of the processing solution so that the amount of the processing solution stored in the processing tank is recognized more accurately. Even if a low cost level sensor or a pressure sensor (a low accuracy sensor) is employed, this object can be achieved.

The discharge means according to each aspect is means for discharging the processing solution from one processing tank. In a case where the processing tank is a tank from which waste water is discharged, it is a means for discharging waste water. In a case where the processing solution is cascaded from another processing tank, the means is a cascade means.

DESCRIPTION OF THE EMBODIMENTS

First Embodiment

A first embodiment of the present invention will now be described with reference to FIGS. 1 and 2.

Figure 1:
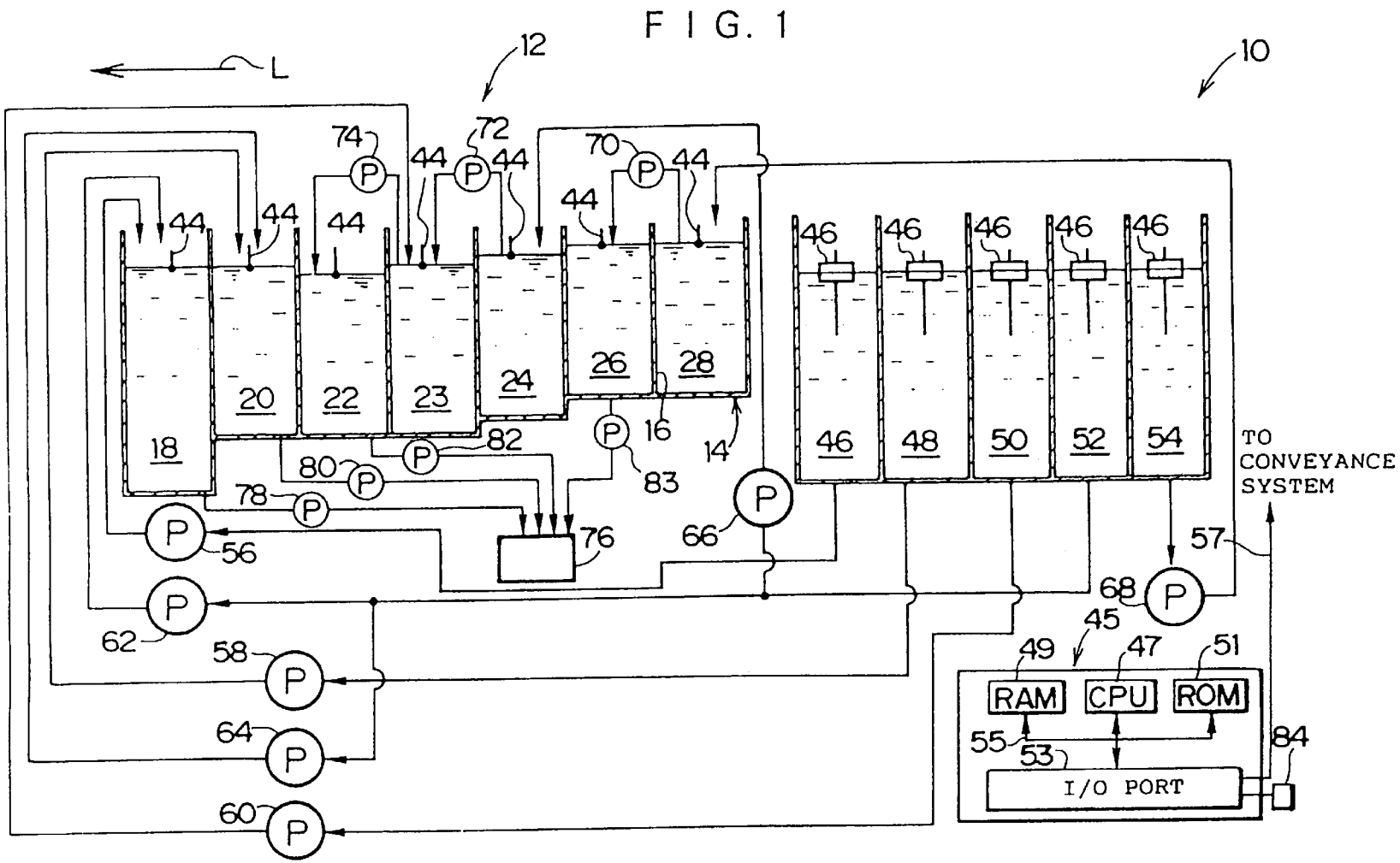
FIG. 1 is a schematic view showing the structure of an automatic development unit according to a first embodiment of the present invention.

FIG. 1 shows a processing section 12 of an automatic developing unit 10 to which the present invention is embodied. Note that a film loading portion (not shown) is provided in a portion of the processing section 12 indicated by an arrow L.

The processing section 12 has a box-like frame 14. A plurality of erected walls 16 are provided over the bottom of the frame 14 so that a development tank 18, a bleaching tank 20, a first fixation tank 22, a second fixation tank 23, a washing tank 24, a first stabilization tank 26 and a second stabilization tank 28 are formed. The development tank 18 stores developer, the bleaching tank 20 stores bleaching solution, the first and second fixation tanks 22 and 23 store fixation solution, the washing tank 24 stores washing water, the first and second structure stabilization tanks 26 and 28 store stabilization solution.

Figure 2:
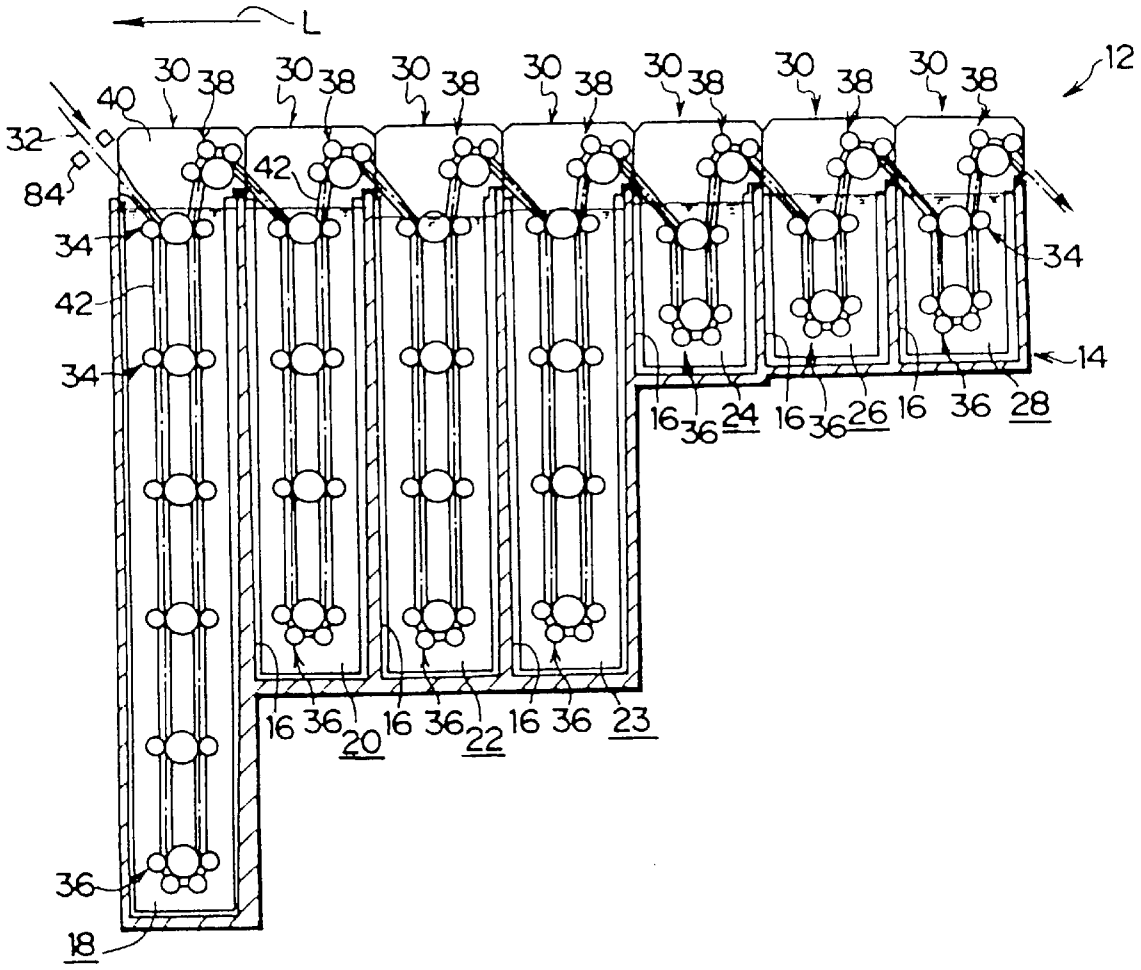
FIG. 2 is a schematic view showing a conveyance system of the automatic development unit shown in FIG. 1.

As shown in FIG. 2, a processing rack 30 is disposed in each processing tank in the processing section 12. The processing rack 30 is immersed in the processing solution except the upper portion.

The processing rack 30 comprises a conveyance roller 34 and a reversal roller 36 for conveying a film 32 in the processing solution and a squeeze roller 38 for squeezing and sending the film (Film 135 in this embodiment) 32 to an adjacent processing tank. The conveyance roller 34, the reversal roller 36 and the squeeze roller 38 are rotated by motors (not shown).

The processing rack 30 has a pair of side plates 40 (only one plate is shown in FIG. 2) for forming a portion of a support member. The side plate 40 has, in the inner surface thereof, guide grooves 42 for guiding the two edges of the film 32.

The film 32 is, while being warped, conveyed in each processing tank and among the adjacent processing tanks by the processing rack 30. After the film 32 has been discharged from the final second stabilization tank 28, the film 32 is introduced into a drying section (not shown).

The drying section is provided with a hot air supply means composed of a heater and a blower. Hot air generated by the hot air supply means is supplied to the drying section so that the film 32 moving in the drying section is exposed to hot air so as to be dried.

The automatic development unit 10 is adapted to a so-called leaderless method so that the film 32 is guided by the guide grooves 42 and allowed to pass through each processing tank even if no leader is provided.

As shown in FIG. 1, each of the development tank 18, bleaching tank 20, first fixation tank 22, second fixation tank 23, washing tank 24, first stabilization tank 26 and the second stabilization tank 28 is provided with a hot thermistor sensor (trade name of Shibaura Denshi) 44 for detecting the level of each solution. Note that the hot thermistor sensor 44 is connected to a control unit 45 so that the level is detected in accordance with a change in the temperature when the processing solution has is brought into contact with (or when the same has been separated from) the hot thermistor sensor 44.

The automatic development unit 10 has a developer replenishment tank 46 storing replenishment developer, a bleacher replenishment tank 48 storing replenishment bleacher, a fixing solution replenishment tank 50 storing replenishment fixing solution, a water replenishment tank 52 storing replenishment water and a stabilizer replenishment tank 54 storing stabilizer.

Each of the developer replenishment tank 46, the bleacher replenishment tank 48, the fixing solution replenishment tank 50, the water replenishment tank 52 and the stabilizer replenishment tank 54 has a float-type level detection sensor 46 for detecting the level. The float-type level detection sensor 46 is connected to the control unit 45.

The developer in the developer replenishment tank 46 is replenished to the developer tank 18 by a proportioning pump 56.

The bleacher in the bleacher replenishment tank 48 is replenished to the bleacher tank 20 by a proportioning pump 58.

The fixing solution in the fixing solution replenishment tank 50 is replenished to the second fixation tank 23 by a proportioning pump 60.

Water in the water replenishment tank 52 is replenished to the developer tank 18 by a proportioning pump 62, and then replenished to the bleacher tank 20 by a proportioning pump 64 and then replenished to the washing tank 24 by a proportioning pump 66.

Stabilizer in stabilizer replenishment tank 54 is replenished to the second stabilization tank 28 by a proportioning pump 68.

The processing section 12 has a proportioning pump 70 for discharging the stabilizer in the second stabilization tank 28 to the first stabilization tank 26, a proportioning pump 72 for discharging water in the washing tank 24 to the second fixation tank 23, a proportioning pump 74 for discharging fixing solution in the second fixation tank 23 to the first fixation tank 22, a waste water tank 76 for storing waste water, a proportioning pump 78 for discharging the developer in the developer tank 18 to the waste water tank 76, a proportioning pump 80 for discharging the bleacher in the bleacher tank 20 to the waste water tank 76, a proportioning pump 82 for discharging the fixing solution in the first fixation tank 22 to the waste water tank 76 and a proportioning pump 83 for discharging the stabilizer in the first stabilization tank 26 to the waste water tank 76. The proportioning pumps 56, 58, 60, 62, 64, 66, 68, 70, 72, 74, 78, 80, 82 and 83 are controlled by the control unit 45.

Each of the processing tanks is provided with a temperature adjustment means (not shown) which has a solution temperature sensor and a heater. The temperature adjustment means detects the temperature of the processing solution by the solution temperature sensor and controls the heater to make the temperature of the processing solution in each processing tank constant.

The control unit 45 comprises a CPU 47, a RAM 49, a ROM 51 and an I/O port 53 which are connected to one another by a bus 55 consisting of a data bus and a control bus. The foregoing proportioning pumps 56, 58, 60, 62, 64, 66, 68, 70, 72, 74, 78, 80, 82 and 83 are connected to the I/O port 53 through a driver (not shown). A signal line 57 connected to a drive system for rotating each roller in the processing rack 30 and a film sensor 84 disposed at the inlet portion of the developer tank 18 are connected to I/O port 53 so that the amount of the processed film 32 is detected. The ROM 51 stores a lookup table showing outputs (the solution levels) of the hot thermistor sensor 44 previously obtained by experiments or the like and the amount of the processing solution in each processing tank, for example, the developer tank 18. The CPU 47 obtains the amount of the processing solution in each processing tank in accordance with the output from the hot thermistor sensor 44 and the lookup table by performing calculations.

A method of replenishing the replenisher solution will now be described.

When the films 32 have been processed by a predetermined quantity, the proportioning pumps 56, 58, 60 and 68 are operated so that the developer in a quantity corresponding to the amount of the processed films 32 is replenished from the developer replenishment tank 46 to the developer tank 18, the bleacher in a quantity corresponding to the amount of the processed films 32 is replenished from the bleacher replenishment tank 48 to the bleacher tank 20, the fixing solution in a quantity corresponding to the amount of the processed films 32 is replenished from the fixing solution replenishment tank 50 to the second fixation tank 23 and the stabilizer in a quantity corresponding to the amount of the processed films 32 is replenished from the stabilizer replenishment tank 54 to the second stabilization tank 28.

Then, the proportioning pumps 78, 80 and 82 are operated so that the developer in a required quantity for the process is discharged from the developer tank 18 to the waste water tank 76, the bleacher in a required quantity for the process is discharged from the bleacher tank 20 to the waste water tank 76, the fixing solution in a quantity required for the process is discharged from the first fixation tank 22 to the waste water tank 76 and the stabilizer in a quantity required for the process is discharged from the first stabilization tank 26 to the waste water tank 76.

After the discharge of each waste water has been performed, the solution level is made to be lower than a predetermined level if the processing solution is evaporated. Therefore, the hot thermistor sensor 44 of the developer tank 18 detects a fact that the developer in the developer tank 18 has been made to be lower than a predetermined level. Also, the hot thermistor sensor 44 of the bleacher tank 20 detects that the bleacher in the bleacher tank 20 has been made to be lower than a predetermined level. Then, the control unit 45 operates the proportioning pumps 62 and 64 to replenish the replenisher water until the developer in the developer tank 18 reaches a predetermined level and until the bleacher in the bleacher tank 20 reaches a predetermined level. As a result, water is accurately added to compensate the amount of evaporation in the developer tank 18 and the bleacher tank 20.

Since the fixing solution in the first fixation tank 22 is discharged to the waste water tank 76, the fixing solution in the first fixation tank 22 is made to be considerably lower than the predetermined level. Then, the control unit 45 operates the proportioning pump 74 so that the fixing solution is replenished from the second fixation tank 23 until the fixing solution in the first fixation tank 22 reaches a predetermined level.

As a result, the fixing solution in the second fixation tank 23 is made to be considerably lower than a predetermined level. Then, the control unit 45 operates the proportioning pump 72 so that washing water is replenished from the washing tank 24 until the fixing solution in the second fixation tank 23 reaches a predetermined level.

After washing water has been replenished from the washing tank 24 to the second fixation tank 23, washing water in the washing tank 24 is made to be considerably lower than a predetermined level. Then, the control unit 45 operates the proportioning pump 66 so that replenisher water is replenished from the water replenishment tank 52 until washing water in the washing tank 24 reaches a predetermined level.

After the hot thermistor sensor 44 of the first stabilization tank 26 has detected the fact that washing water in the first stabilization tank 26 has been made to be lower than a predetermined level, the control unit 45 operates the proportioning pump 70 so that the stabilizer is replenished from the second stabilization tank 28 until the stabilizer in the first stabilization tank 26 reaches a predetermined level. If the hot thermistor sensor 44 of the second stabilization tank 28 has detected the fact that the stabilizer in the second stabilization tank 28 has been made to be lower than a predetermined level, the control unit 45 operates the proportioning pump 68 so that the stabilizer is replenished from the stabilizer replenishment tank 54 until the stabilizer in the second stabilization tank 28 reaches a predetermined level.

As described above, this embodiment has the structure such that the replenisher solution is replenished in a quantity corresponding to the processed amount of the films 32; the quantity required for the process is cascaded or discharged; and then water is added in a quantity corresponding to the evaporation. Therefore, the quality of the processing solution can stably be maintained even if the system is a low replenishment system or adapted to a small-amount method. Note that the stabilizer tank is replenished with the stabilizer in place of washing water. Washing water may be added to the stabilizer tank from the water replenishment tank by a pump.

EXAMPLES

Figure 11:
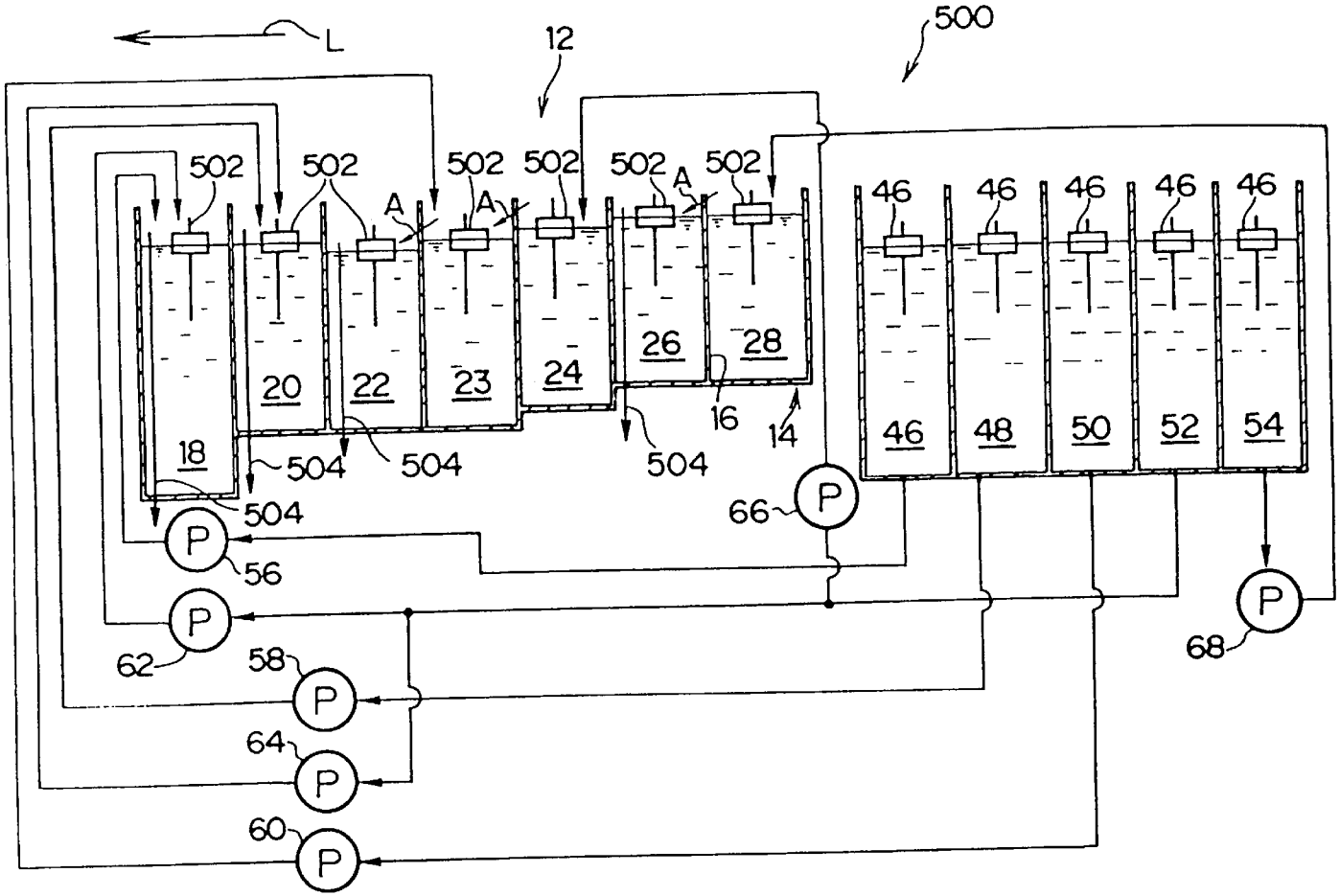
FIG. 11 PRIOR ART
FIG. 11 is a schematic view showing the structure of a conventional automatic development unit.

Table 4 shows a concentration ratio (an equilibrium concentration after 5400 films have been processed) of each of the developer, the bleacher and the fixing solution under respective conditions on an assumption that the concentration (a theoretical concentration on an assumption that no evaporation takes place) of the automatic development unit 10 and a conventional automatic development unit 500 shown in FIG. 11 are under a standard condition.

The conventional automatic development unit 500 (in which the same elements as those of the automatic development unit 10 according to this embodiment are given the same reference numerals) has a float-type solution level sensor (ON/OFF type) 502 provided for each processing tank. Moreover, the structure is arranged such that cascade is performed from the second stabilization tank 28 to the first stabilization tank 26, from the washing tank 24 to the second fixation tank 23 and from the second fixation tank 23 to the first fixation tank 22 by overflow (indicated by an arrow A shown in FIG. 11). Thus, the developer in the developer tank 18, the bleacher in the bleacher tank 20, the fixing solution in the first fixation tank 22 and the stabilizer in the first stabilization tank 26 are arranged to be discharged to the outside of the tank through an overflow pipe 504.

Table 1 below shows the amount of evaporation and the amount of replenishment of the processing solution to each tank when 15 films (24 frames the size of which is 135) per day are processed. Table 2 shows the amount of evaporation and the amount of replenishment of the processing solution to each tank when 30 films (24 frames the size of which is 135) per day are processed. Table 3 shows the ratio of the amount of evaporation with respect to the amount of replenishment for each processing tank.

TABLE 1

| | Processing Condition | Developer | Bleacher | Fixing Solution in First Fixation Tank | Fixing Solution in Second Fixation Tank | Washing Water in Washing Water Tank | Stabilizer in First Stabilization Tank | Stabilizer in Second Stabilization Tank |
|---|---|---|---|---|---|---|---|---|
| 15 films/day | Amount of Evaporation (ml) | 204.08 | 104.03 | 111.78 | 64.68 | 122.48 | 103.43 | 165.38 |
| | Amount of Replenishment of Processing Salution (ml) | 315 | 75 | — | 120 | 255 | — | 225 |

Vapor pressure in the environment for processing: 13 mmHg, standby time per day: 690 minutes, drive time: 30 minutes, pause time: 720 minutes.

TABLE 2

| | Processing Condition | Developer | Bleacher | Fixing Solution in First Fixation Tank | Fixing Solution in Second Fixation Tank | Washing Water in Washing Water Tank | Stabilizer in First Stabilization Tank | Stabilizer in Second Stabilization Tank |
|---|---|---|---|---|---|---|---|---|
| 30 films/day | Amount of Evaporation (ml) | 224.78 | 143.11 | 119.07 | 70.22 | 136.18 | 118.01 | 191.33 |
| | Amount of Replenishment of Processing Solution (ml) | 630 | 150 | — | 240 | 510 | — | 450 |

Vapor pressure in the environment for processing: 13 mmHg, standby time per day: 515 minutes, drive time: 205 minutes, pause time: 720 minutes.

TABLE 3

| | | Developer | Bleacher | Fixing Solution in First Fixation Tank | Fixing Solution in Second Fixation Tank | Washing Water in Washing Water Tank | Stabilizer in First Stabiliza-tion Tank | Stabilizer in Second Stabiliza-tion Tank |
|---|---|---|---|---|---|---|---|---|
| Ratio of Amount of Evaporation with Respect to Amount of Replenishment | 15 films/day | 65% | 139% | 80% | 80% | 80% | 119% | 119% |
| | 30 films/day | 36% | 95% | 43% | 43% | 43% | 69% | 69% |

As can be understood from Table 3, if the amount of process per day is small, the ratio of the amount of evaporation with respect to the amount of replenishment of the processing solution is enlarged and therefore the system is considerably affected by an error in correcting evaporation.

TABLE 4

Condensation ratio (equilibrium concentration after 5400 films have been processed) under respective conditions on a assumption that the concentration (a theoretical concentration on an assumption that no evaporation takes place) under the stanard condition is 1.

| | Condensation Ratio | | | | |
|---|---|---|---|---|---|
| Processing Condition | Developer in Developer Tank | Bleacher in Bleacher Tank | Fixing Solution in First Fixation Tank | Fixing Solution in Second Fixation Tank | Fixing Solution in Washing Water Tank |
| Embodiment: 15 films/day | 0.9926 | 0.9934 | 1.0033 | 0.8469 | 0.6316 |
| Comparative Example: 30 films/day | 1.0609 | 1.2080 | 1.1376 | 0.9586 | 0.8091 |
| Comparative Example: 15 films/day | 1.1405 | 1.5390 | 1.3171 | 0.9422 | 0.6982 |

Since there is no carry over by the film before the process is started, the concentration in the washing tank is zero (only water exists). As the process proceeds, the fixing solution is carried from the previous tank. Therefore, the condensation ratio of the concentration of the carried fixing solution when the running equilibrium has been realized is shown.

The comparative example resulted in a condensation of about 6% in the-development tank when 30 films were processed per day and a condensation of about 14% when 15 films were processed per day. In the bleacher tank, a condensation of about 21% took place when 30 films were processed per day and that of about 54% took place when 15 films were processed per day.

On the other hand, examples of the present invention did not encounter condensation. In the water washing tank, the carried fixing solution is diluted attributable to addition of water and therefore the concentration is lowered. Therefore, a preferred process was realized.

Since the conventional automatic development unit 500 involves an error in adding water, it suffers from the problem in that the condensation rate is raised excessively if the amount of process is small, such as 15 films/day. However, the present invention, which is capable of eliminating the error in adding water, is able to maintain stable processing solution even if the amount of the process is 15 films/day.

Second Embodiment

An automatic development unit 210 according to a second embodiment of the present invention will now be described.

Figure 3:
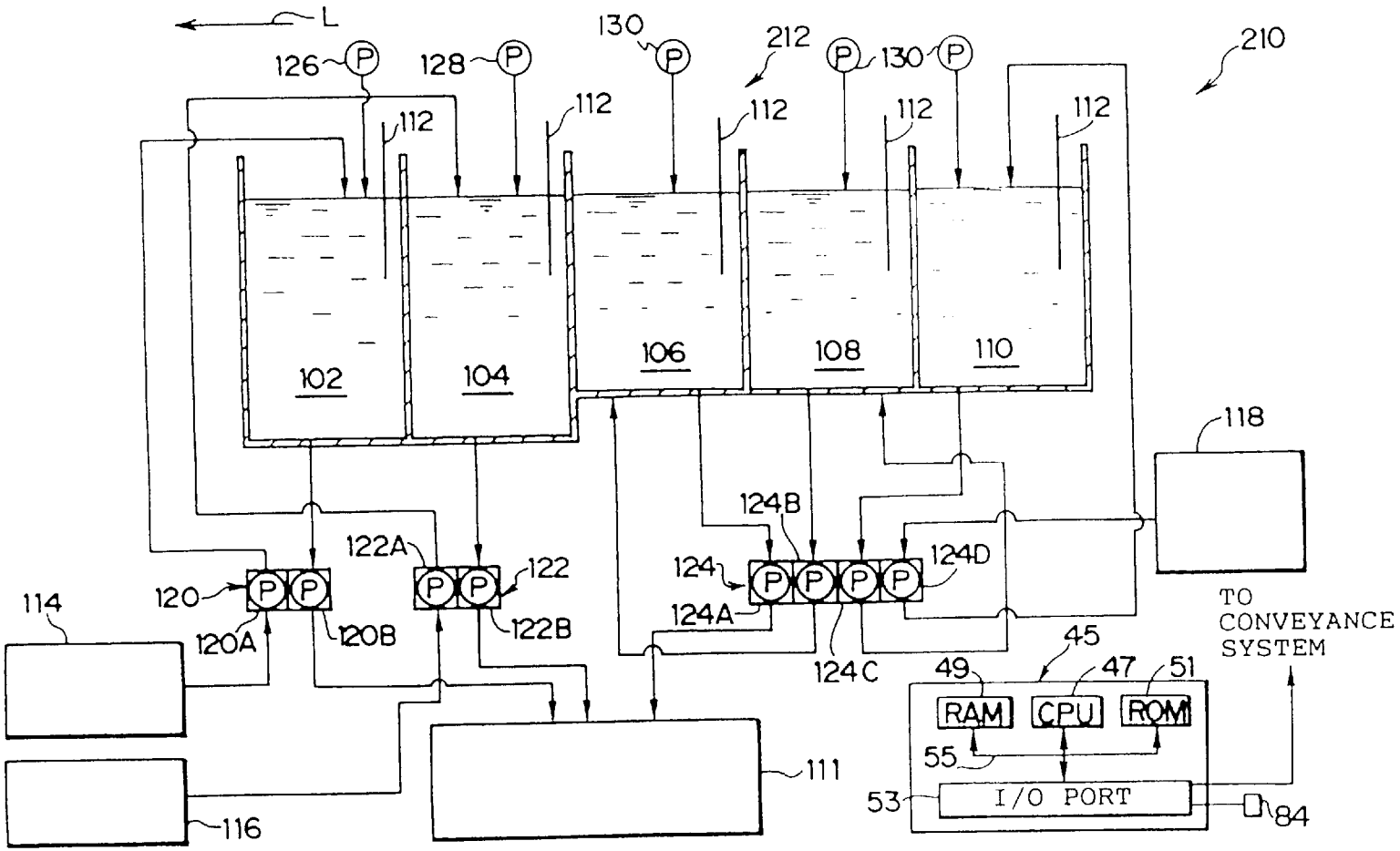
FIG. 3 is a schematic view showing the structure of an automatic development unit according to a second embodiment of the present invention.

As shown in FIG. 3, the automatic development unit 10 according to the second embodiment comprises a processing section 210. The processing section 210 has a development tank 102, a bleaching and fixing tank 104, a first washing tank 106, a second washing tank 108, a third washing tank 110 and a waste water tank 111. Although omitted from illustration, this embodiment also has a structure such that each tank is provided with a processing rack for conveying films.

Each of the development tank 102, the bleaching and fixing tank 104, the first washing tank 106, the second washing tank 108 and the third washing tank 110 is provided with an accurate level sensor 112 for accurately detecting the solution level. The accurate level sensor 112 comprises a float (not shown) arranged to float on the processing solution and a laser-type displacement sensor (not shown) (laser-type displacement sensor of LB series manufactured by Kence) and structured to detect the position of the float by the laser-type displacement sensor so as to successively measure the solution level. Note that the accurate level sensor 112 is connected to the control unit 45.

The processing section 210 has a developer replenishing tank 114 storing a replenishment developer, a bleacher and fixing solution replenishing tank 116 storing replenishment bleacher and fixing solution, a washing water replenishing tank 118 storing replenishment washing water, a twin pump 120, a twin pump 122 and a quadruple pump 124.

The twin pump 120 is integrated by connecting a pump 120A and a pump 120B, while the twin pump 122 is integrated by connecting a pump 122A and a pump 122B. One motor (not shown) is rotated to simultaneously operate the two pumps.

On the other hand, the quadruple pump 124 is integrated by connecting a pump 124A, a pump 124B, a pump 124C and a pump 124D. One motor is rotated to simultaneously operate all four pumps.

The twin pump 120, the twin pump 122 and the quadruple pump 124 are controlled by the control unit 45. In this embodiment, each of the twin pump 120, the twin pump 122 and the quadruple pump 124 is a cylinder pump.

In this embodiment, when the twin pump 120 has been operated, the developer in the developer replenishing tank 114 is replenished into the development tank 102, and simultaneously developer in the development tank 102 is discharged into the waste water tank 111.

When the twin pump 122 has been operated, the bleacher and the fixing solution in the bleacher and fixing solution replenishing tank 116 is replenished into the bleaching and fixing tank 104, and simultaneously the bleacher and fixing solution in the bleaching and fixing tank 104 is discharged into the waste water tank 111.

When the quadruple pump 124 has been operated, washing water in the first washing tank 106 is discharged into the waste water tank 111, and simultaneously the washing water in the second washing tank 108 is discharged into the first washing tank 106. Moreover, washing water in the third washing tank 110 is discharged into the second washing tank 108, and the replenishment washing water in the washing water replenishing tank 118 is replenished into the third washing tank 110.

The twin pump 120 is set in such a manner that the quantity to be discharged from the pump 120B adjacent to the waste water section is smaller than that discharged from the pump 120A in the replenishment portion by a quantity corresponding to the carry over (previously obtained by performing experiments) attributable to the film (not shown). On the other hand, all of the pumps of the twin pump 122 and the quadruple pump 124 are set to have the same discharge.

Water replenishment to the development tank 102 is performed by the water adding pump 126, that to the bleaching and fixing tank 104 is performed by the water adding pump 128, and that to the first washing tank 106, the second washing tank 108 and the third washing tank 110 is performed by the water adding pump 130. The water adding pumps 126, 128 and 130 are controlled by the control unit 45. In this embodiment, each of the water adding pumps 126, 128 and 130 is a bellows pump.

A method of replenishing replenisher solution according to this embodiment will now be described.

After the films 32 have been processed in a predetermined quantity, the twin pumps 120 and 122 are operated so that the developer in the developer replenishing tank 114 is replenished into the development tank 102 and the bleacher and fixing solution in the bleacher and fixing solution replenishing tank 116 is replenished to the bleaching and fixing tank 104 in such a manner that the replenishment is performed in a quantity corresponding to the amount of the processing of each film 32. Moreover, the developer in the development tank 102 and the bleacher and fixing solution in the bleaching and fixing tank 104 are discharged to the waste water tank 111 in a predetermined quantity required to waste water. Simultaneously, the quadruple pump 124 is operated so that cascading or discharge of washing water in the third washing tank 110 to the second washing tank 108, that in the second washing tank 108 to the first washing tank 106, and that in the first washing tank 106 to the waste water tank 111 are performed in each quantity corresponding to the amount of processing of each film 32.

After cascading or discharge by the twin pumps 120 and 122 and the quadruple pump 124 has been completed, the water adding pumps 126, 128 and 130 are operated so that water is added until the solution level is raised to a predetermined level for the development tank 102, the bleaching and fixing tank 104, the first washing tank 106, the second washing tank 108 and the third washing tank 110.

As described above, this embodiment also has the structure such that the replenisher solution is replenished corresponding to the amount of the processing of films and cascade or discharge in a quantity required to satisfy the predetermined prescription; and then water is added to compensate for the amount of evaporation. Therefore, the quality of the processing solution can stably be maintained even with a small quantity replenishment method or a small amount of process.

EXAMPLES

An automatic development unit 210 was manufactured in which the capacities (the full capacity) of the processing tanks were set such that the capacity of the development tank 102 was 2700 milliliters, that of the bleaching and fixing tank 104 was 2600 milliliters, that of the first washing tank 106 was 1000 milliliters, that of the second washing tank 108 was 1000 milliliters and that of the third washing tank 110 was 1400 milliliters; and the area of opening of each processing tank was 30 $cm^2$ or smaller. The amount of evaporation from each tank was measured, thus resulting in about 6.64 milliliters per day.

Then, a temporarily set mother solution (for the processing tank) and the replenisher solution (for the replenisher tank) were prepared experimentally so that a running process was performed to measure change in the concentration of the mother solution. The running process was performed such that a predetermined amount of films were processed every day and replenishment of 50 milliliters (of the respective replenisher solutions) was performed for each day to each of the development tank 102, the bleaching and fixing tank 104 and the third washing tank 110. At the time of performing the running process, the amount of carry over and that of carry in attributable to the films among the processing tanks was 7.5 milliliters per day. Under the foregoing conditions, the process was performed until the total quantity of the replenisher solution in the development tank 102 was made to be 12500 milliliters (about 4.6 rounds: the mother solution in the tank was replaced by about 4.6 times) (for about 250 days).

A process for every day was performed as follows:

Films to be processed in one day (five 135-films having 24 frames) were divided into five portions which were sequentially processed. Whenever one operation (one film) was processed, replenishment of the processing solution in a quantity of 10 milliliters was performed. During one process, each of carry in and carry out in a quantity of 1.5 milliliters was realized.

The twin pumps 120 and 122 and the quadruple pump 124 were operated to perform discharge (waste water or perform cascade) simultaneously with replenishment such that the twin pump 120 performed replenishment in a quantity of 10 milliliters at each time and discharge in a quantity of 8.5 milliliters.

On the other hand, the twin pump 122 and the quadruple pump 124 perform replenishment in a quantity of 10 milliliters for each time and discharge or cascade in a quantity of 10 milliliters. The level in each processing tank was detected to monitor changes in the level with respect to a reference level (the full level) set before the start of the process. Lowering of the level when each pump was being operated accurately was considered to be the quantity of evaporation and water was added to compensate the amount of evaporation by the water adding pumps 126, 128 and 130 (to the full level). A different between the actual amount of evaporation (a predetermined value) and the value of the actual addition was considered to be an error in correcting evaporation.

Whenever one process was completed (the replenishment and the discharge), the level of the processing solution was detected to obtain the amount of evaporation (the amount of the solution was obtained in accordance with the difference from the level at the full capacity).

Since the replenishment and the discharge were performed accurately, the difference was the amount of evaporation. The amount of evaporation was, once a day, replenished by adding water to a predetermined level by the water adding pumps 126, 128 and 130.

Figure 4:
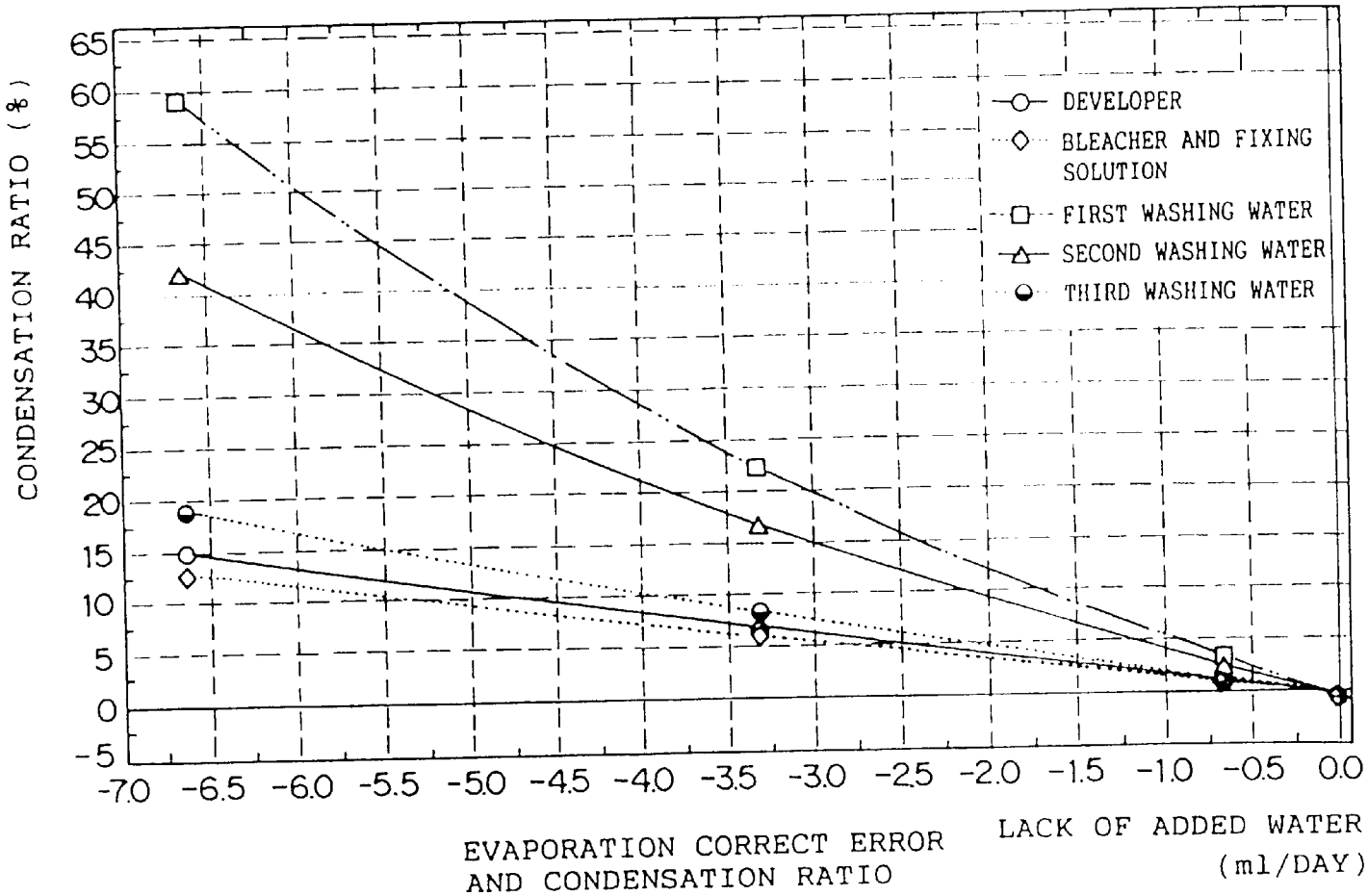
FIG. 4 is a graph showing the relationship between the amount of lack of added water to the processing solution and the condensation ratio in an assumption case where the amount of water addition is reduced.

The condensation rate of each processing solution realized when the amount of addition of water is temporarily reduced is shown in FIG. 4. As a result of experiments, if running is performed such that the quantity corresponding to the actual amount of evaporation is accurately added as shown in FIG. 4 (when lack of the addition of water was zero), no condensation takes place. If a slight quantity of addition error of several milliliters per day takes place, the concentration is changed considerably. For example, if the quantity of addition of water lacks by about 4.5 milliliters/day in the development tank, the concentration is raised by about 10% and the processing performance deteriorates (the developer tank has a small allowable condensation rate for the processing performance as compared with other tanks).

In the case of an automatic development unit in which the total amount of replenishment per day is small, slight evaporation changes the concentration of the processing solution. Therefore, it can be considered that accurate replenishment, addition of water and discharge are required. The structure according to this solution is such that discharge and replenishment are simultaneously controlled so that accurate addition of water is performed and condensation is prevented. As a result, the processing solution can be maintained in an excellent state.

Third Embodiment

A third embodiment employs an automatic development unit having substantially the same structure as that according to the second embodiment. Moreover, a portion of a water addition method (Japanese Patent Application Laid-Open (JP-A) No. 5-181250) is employed in which the relationship among the temperature and humidity of environment of the apparatus and the amount of evaporation from the processing solution is previously obtained; the temperature and relative humidity were detected; and the quantity of water which is added to the processing tank is determined in accordance with the detected temperature, the relative humidity and the foregoing relationship.

Figure 5:
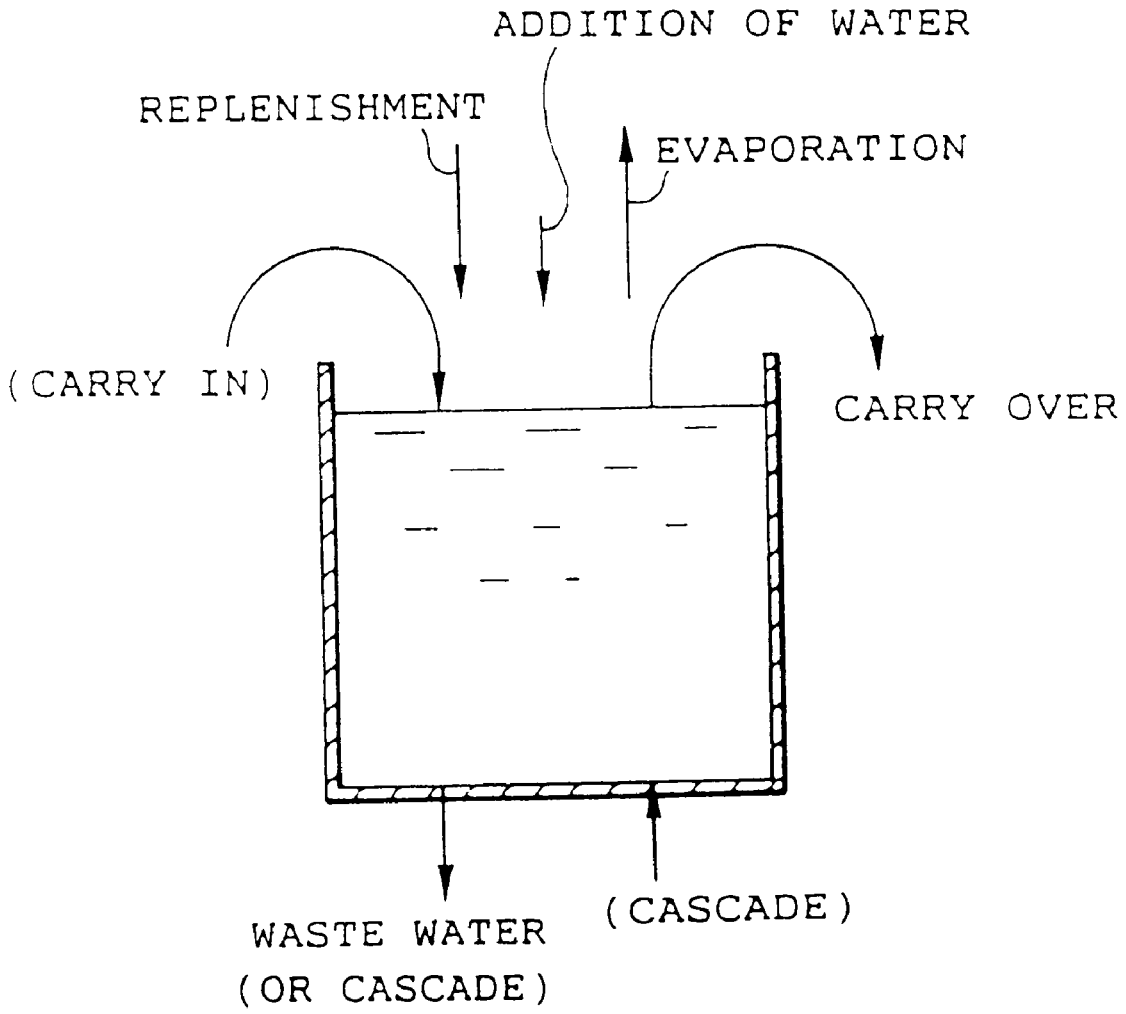
FIG. 5 is an explanatory view showing the relationship of solutions to be introduced and discharged to and from one processing tank.

Solutions are introduced and discharged to and from one processing tank as shown in FIG. 5. In an actual automatic development unit, detection and measurement of the amount of replenishment, the amount of addition of water, the amount of carry over, the amount of carry in, the amount of evaporation, the amount of the waste water and the amount of cascade can be measured or cannot be measured as shown in Table 5.

Figure 6:
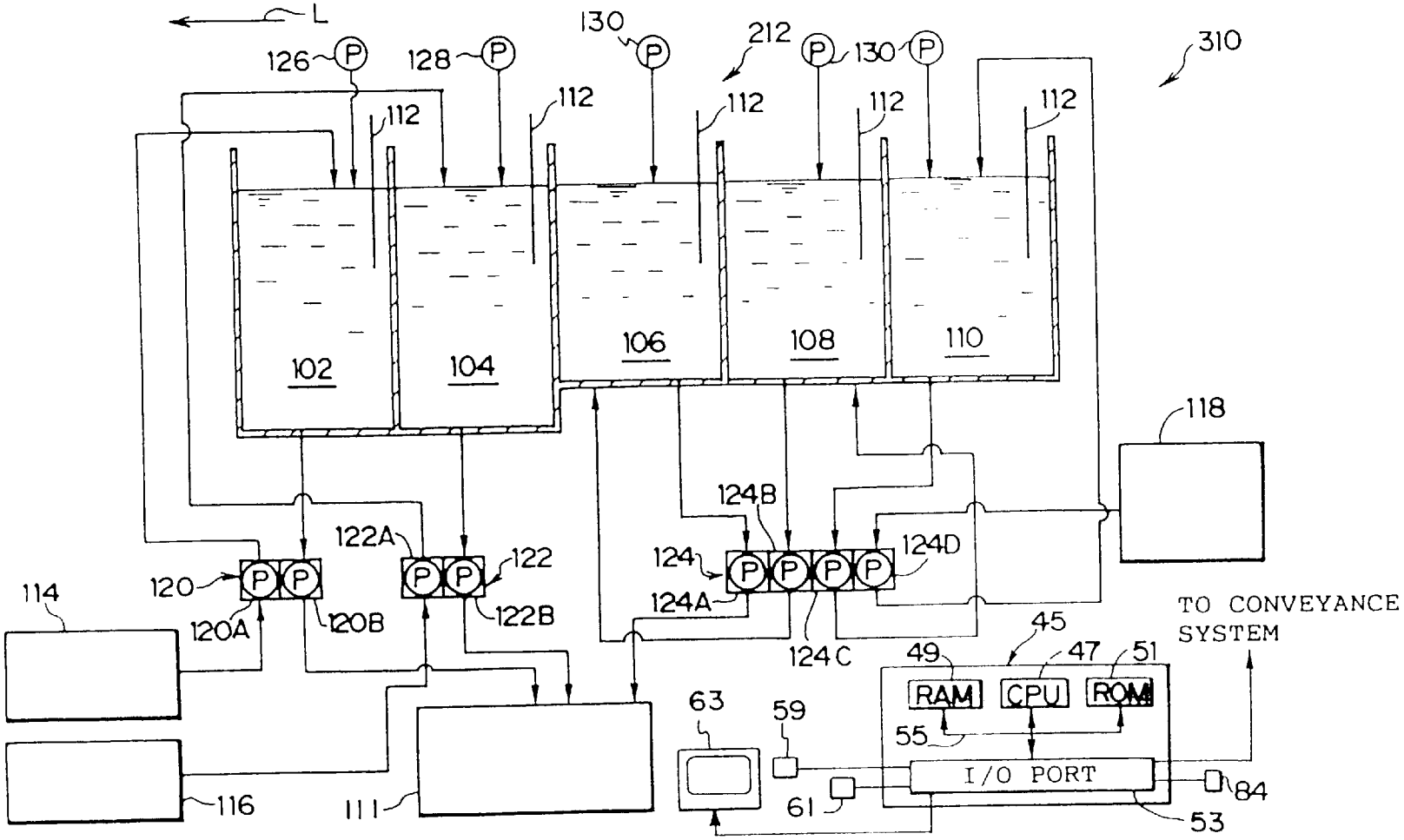
FIG. 6 is a schematic view showing the structure of an automatic development unit according to a third embodiment of the present invention.

As shown in FIG. 6, the third embodiment has the structure such that a temperature sensor 59 and a humidity sensor 61 are connected to the I/O port 53 of the control unit 45. The temperature sensor 59 and the humidity sensor 61 are disposed on the outside of the automatic development unit 310 so as to detect the temperature and relative humidity of the indoor environment in which the automatic development unit 310 is installed. Note that the positions of the temperature sensor 59 and the humidity sensor 61 may be any positions at which the temperature and relative humidity of the indoor environment in which the automatic development unit 310 is installed can be detected. For example, they may be disposed in the automatic development unit 10 to detect the temperature and relative humidity of external air introduced into the unit by an air fan or the like.

The control unit 45 stores the evaporation rates of the processing solution which can be obtained by combining the temperature, humidity and state of operation (during operation, standby and interruption). The temperature and humidity during the operation, standby or interruption are monitored so as to calculate the amount of evaporation from each tank. Moreover, the control unit 45 compares the amount of evaporation realized from the previous addition of water and the amount of addition of water. If the two amounts are different from each other by a quantity larger than a predetermined value, an alarm is displayed on a display unit 63 connected to the I/O port 53.

Since the amount of evaporation can be detected in this embodiment, input and output of solutions to and from one processing tank can be detected or previously detected and predicted. Moreover, a level sensor and a pressure gauge are provided to serve as means for detecting the amount of the stored processing solution so as to detect changes in the amount of the stored solution. Therefore, even if a defect takes place in a portion relating to input/output of a solution, the defect can quickly be detected. Therefore, a countermeasure can be taken before the processing solution deteriorates.

In this embodiment, if a replenishing pump encounters a defect and thus the amount of replenishment is enlarged, the apparent amount of evaporation is reduced and thus the discharge from the water adding pump is reduced. Therefore, since the amount of the actual reduction is made to be smaller than an amount calculated and estimated by the control unit 45, a defect in the replenishing system can be detected.

Since a defect can be detected if it takes place, the defect can quickly be corrected with a countermeasure.

TABLE 5

| | |
|---|---|
| Amount of replenishment | detectable by a proportioning pump or a flow meter. |
| Amount of addition of water | detectable by a proportioning pump or a flow meter. |
| Amount of carry over | which cannot be detected but which can be measured previously by experiments. Measured data is previously stored so as to be used in actual process. |
| Amount of carry in | which cannot be detected but which can be measured previously by experiments. Measured data is previously stored so as mo be used in actual process. |
| Amount of evaporation | which cannot be detected but which can be measured previously by experiments. Measured data is previously stored so as to be used in actual process. |
| Amount of waste water or Cascade | detectable by a proportioning pump (or a flow meter). |

TABLE 6

| Defective Portion | Phenomenon | Detection | |
|---|---|---|---|
| Replenisher Pump | discharge is enlarged | level is in a trend of rising → apparent amount of evaporation is reduced | detectable because difference from results of calculations arises |
| | discharge is reduced | level is in a trend of lowering → apparent amount of evaporation is enlarged | |
| Discharge Pump | discharge is endlarged | level is in a trend of lowering → apparent amount of evaporation is enlarged | |
| | discharge is reduced | level is in a trend of rising → apparent amount of evaporation is reduced | |
| Squeeze | amount of carry over is enlarged | level is in a trend of moderate lowering → apparent amount of evaporation is enlarged | |
| | amount of carry in is enlarged | level is in a trend of moderate rising → apparent amount of evaporation is reduced | |
| Water Addition Pump | discharge is enlarged | detectable because a predetermined level is not changed even after the water addition pump is operated for a predetermined time while detecting the level by a level sensor | |
| | discharge is reduced | | |

As can be understood from Table 6, if a rapid rise or lowering of the level takes place, the fact that the replenishing or discharge pump has a defect can be detected.

The flow meter may be disposed on the discharge portion of the replenishing pump or a discharge pump. In this case, the detection of-the amount can be performed by the level sensor of the processing tank and the measurement of the amount. Therefore, the amount can accurately be detected.

In a case where a pump unit (the twin pump 122 and the quadruple pump 124) consisting of a plurality of pumps each having the same discharge is employed, the solution level is not changed when the pump is operated. However, a rise or lowering of the level detected by the level sensor denotes occurrence of a defect of any pump.

In a case where the pumps are arranged to respectively act independently, detection of the individual discharge by a level sensor enables a defect to be detected (because the amount of evaporation can be ignored in the short time in which replenishment and discharge is performed).

Although each processing tank has no overflow port for use in a usual operation, an overflow port can be provided as a failsafe such that discharge is performed if the solution level is raised excessively attributable to a defect of the pump or the like.

Fourth Embodiment

Figure 7:
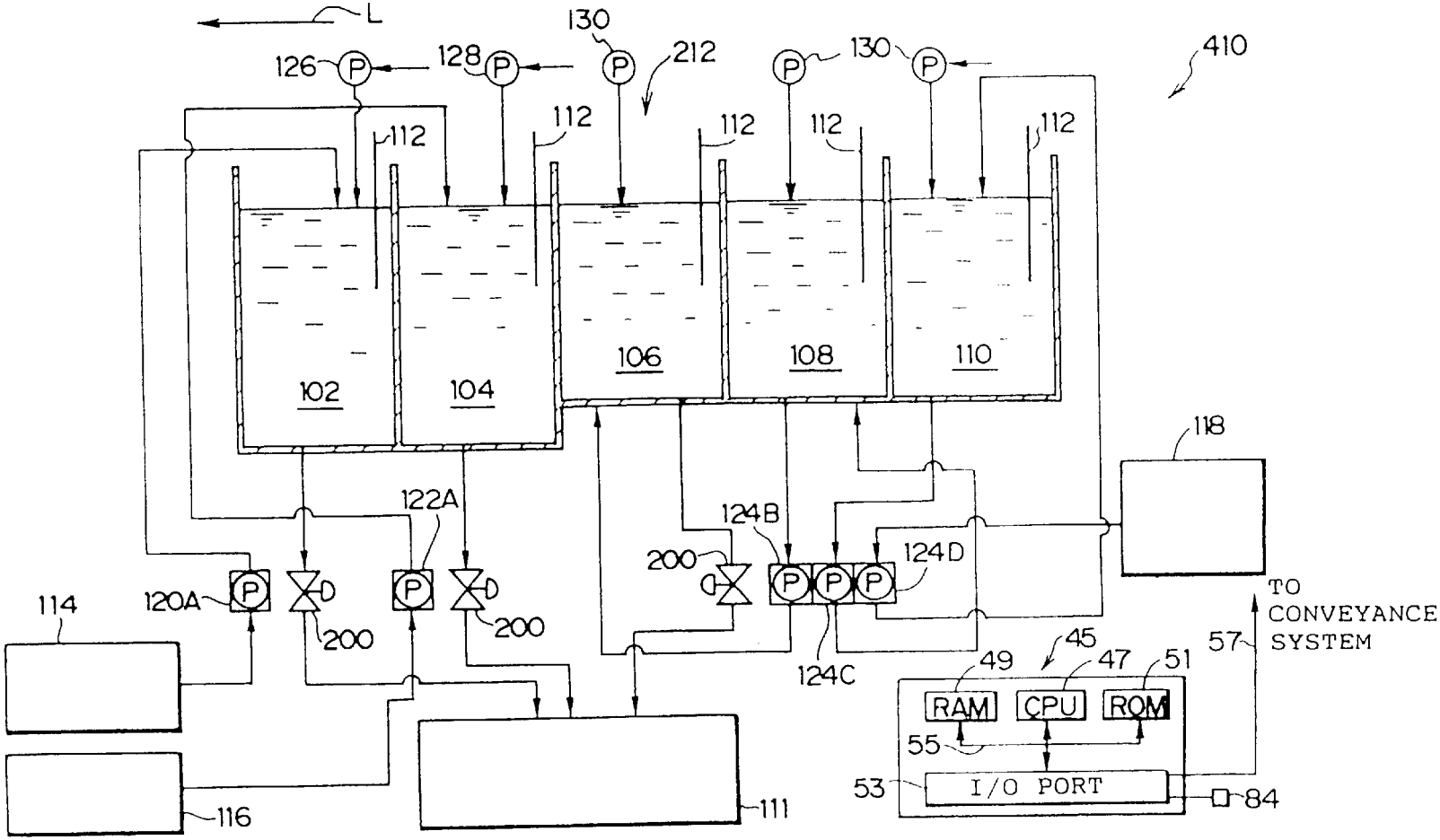
FIG. 7 is a schematic view showing the structure of an automatic development unit according to a fourth embodiment of the present invention.

An automatic development unit 410 according to a fourth embodiment has a structure as shown in FIG. 7 such that the pumps 120B, 122B and 124A for discharging waste water of the automatic development unit 210 (see FIG. 3) according to the second embodiment are replaced by a control valve 200 which can be controlled by the control unit 45.

In this embodiment, the control valve 200 is opened to discharge the processing solution by an amount for one discharge operation while observing with the accurate level sensor 112.

After the level has been lowered to a predetermined level (a capacity), the control valve 200 is immediately closed. Then, the replenishing pumps 120A, 122A and 124B are operated to replenish the replenisher for one replenishing operation. If the level is restored to the original level, a fact that the pumps 120A, 122A and 124B are normal can be detected.

Note that discharge may be performed after replenishment has been performed. Also in this case, if the level is restored to the original level, a fact that the pumps 120A, 122A and 124B are normal can be detected.

As the control valve 200, an electromagnetic valve is preferably employed.

The accurate level sensor 112 may be another sensor besides a sensor comprising a laser measuring machine, such as an ultrasonic sensor, a pressure sensor, an electrostatic capacity type sensor or the like.

The ultrasonic sensor may be an ultrasonic level sensor manufactured by Noken or an ultrasonic level meter manufactured by Yokokawa.

The pressure sensor may be a pressure difference gauge transducer DP15 manufactured by Barydyne, U.S.A.

The electrostatic capacity sensor may be a fluid sensor FS-A or level meter FM-SS manufactured by Lake.

An infrared optical level meter (Level Sensor TLS manufactured by CKD) may be employed.

A float-type level meter of a type exhibiting excellent accuracy (accuracy±1 mm) may be employed (for example, a magnetostrictive level sensor (MS type sensor manufactured by Noken).

Fifth Embodiment

The automatic development unit 610 according to this embodiment is structured to considerably change the level in the processing tank and improve the detection accuracy.

Figure 8A:
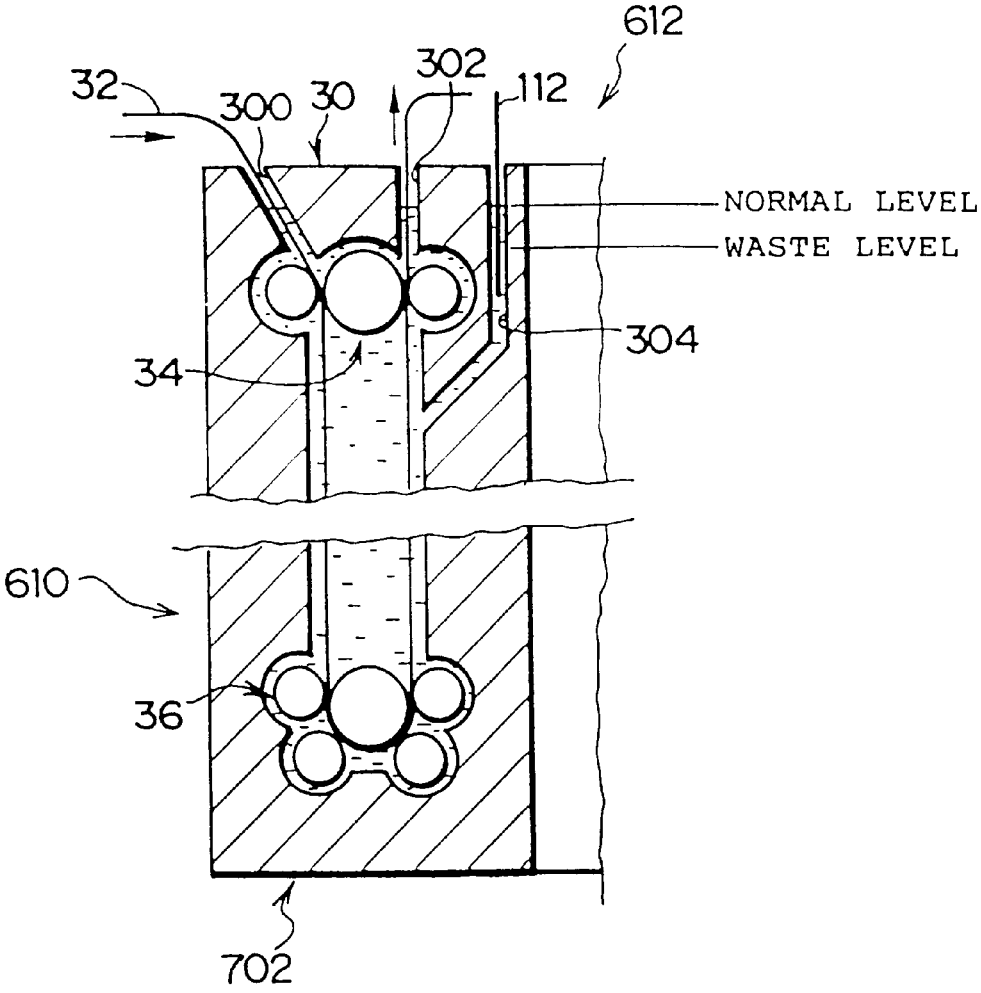
FIG. 8A is a cross sectional view showing a development tank of a automatic development unit according to a fifth embodiment of the present invention.
Figure 8B:
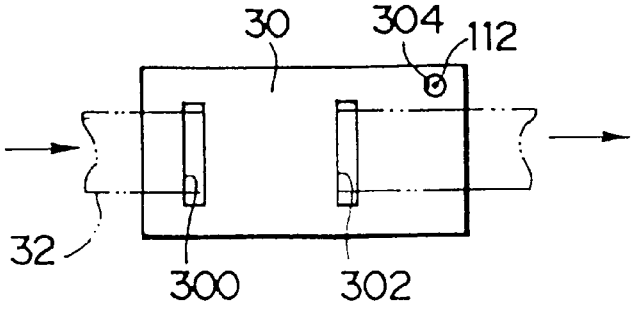
FIG. 8B is a top view of the development tank shown in FIG. 8A.

As shown in FIGS. 8A and 8B, a development tank 702 of a processing section 612 according to this embodiment has a structure such that only the slit-shape inlet port 300 and outlet port 302 through which the film 32 is allowed to pass through and a port 304 through which a level meter having a small diameter is allowed to pass through are opened. In this embodiment, the area of the opened portions is designed such that change per a solution level of 1 mm corresponds to a volume change of the processing solution of 2 milliliters.

That is, assuming that the amount of replenishment for each replenishment operation is 10 milliliters after one film has been processed, discharge or cascade is performed until the level of the processing solution is lowered by 5 mm. Then, replenishment is performed to restore the original level.

In a case where a fact that the amount of carry over of the automatic development unit 610 is 1.5 milliliters per film has been recognized, replenishment is performed after discharge has been performed until the level is lowered by 4.25 mm.

By further reducing the cross sectional area of each of the inlet port 300 and the outlet port 302, through which the film 32 is allowed to pass through, and the port 304 through which the solution level meter is inserted to make the change to be 1 milliliters/mm, the solution level can be controlled with an improved accuracy. In a case where the amount of carry over is zero (including a case where the amount of carry over and that of carry in are set off and thus the amount is made to be substantially zero), the solution level is changed by 10 mm attributable to replenishment and discharge. Therefore, the conveyance distance in the solution is changed by 20 mm between the inlet port portion and the outlet port portion. As a result, it is preferable that replenishment and discharge are not performed during the process because the processing time can be maintained at a constant length. If replenishment and discharge are performed during the process, it is preferable that replenishment and discharge may be performed uniformly as much as possible to prevent change in the solution level. That is, it is preferable that the structure be formed such that the discharge means and the replenishment means are operated in synchronization with each other.

Each of other processing tanks except the development tank 702 has a similar structure so that the solution level is controlled with an excellent accuracy.

Although the foregoing embodiments have the structure such that the processing solution is not diluted and replenished, an operation may be performed in which the replenisher solution is diluted to enlarge the substantial amount of the replenishment and that of waste water in order to improve the accuracy in replenishing the processing solution.

A specific procedure of the foregoing operation will now be described.

Figure 9:
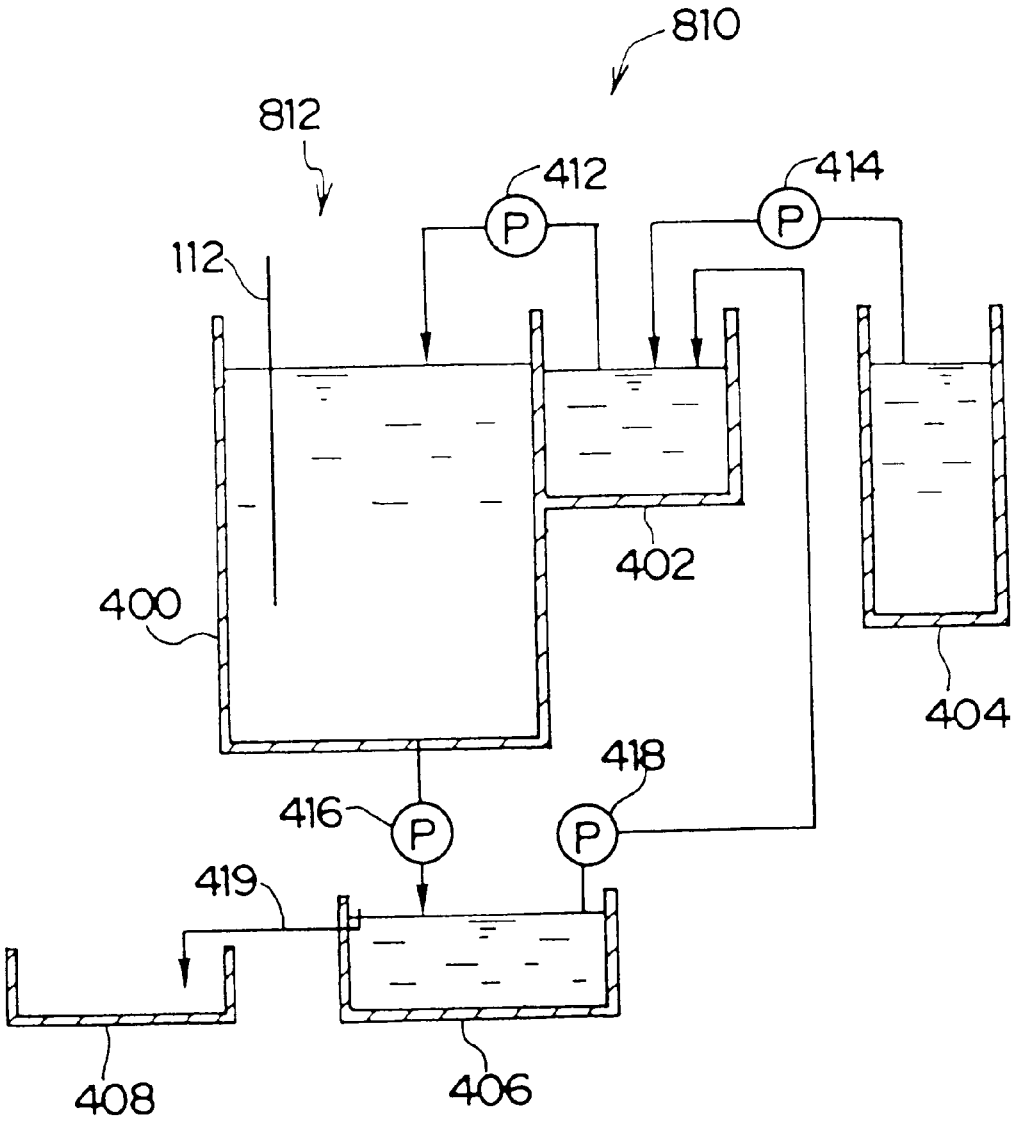
FIG. 9 is a schematic view showing the structure of an automatic development unit according to another embodiment of the present invention.

As shown in FIG. 9, a processing section 812 of the automatic development unit 810 has a processing tank 400, a preparation tank 402, a replenisher tank 404, a buffer tank 406, a waste water tank 408, a pump 412 for discharging the processing solution stored in the preparation tank 402 to the processing tank 400, a pump 412 for discharging the replenisher solution stored in the preparation tank 402 to the processing tank 400, a pump 414 for discharging replenisher solution stored in the replenisher tank 404 to the preparation tank 402, a pump 416 for discharging processing solution stored in the processing tank 400 to the buffer tank 406, and a pump 418 for discharging processing solution stored in the buffer tank 406 to the preparation tank 402. The buffer tank 406 is provided with an overflow pipe 419 for discharging waste water to the waste water tank 408. The processing tank 400 is provided with the accurate level sensor 112.

An operation will now be described with which the replenishment accuracy can be improved to ten times in an example case where 10 milliliters replenisher solution is replenished at each time (in an example system in which the carry over is substantially zero).

The pump 414 is operated before the replenishment operation is performed so that the replenisher solution is, by 100 milliliters, supplied from the replenisher tank 404 to the preparation tank 402.

Then, the pump 418 is operated so that the processing solution in a quantity of 900 milliliters is supplied from the buffer tank 406 to the preparation tank 402 (at the time of start of the operation, the same processing solution as that in the processing tank 400 is stored in the buffer tank 406). As a result, the preparation tank 402 stores a mixture of the processing solution in the buffer tank 406 and the replenisher solution in the replenisher tank 404. Note that the replenisher solution may be supplied to the preparation tank 402 after the processing solution has been supplied to the preparation tank 402.

After the film 32 has been processed and the time at which replenishment must be performed has come, the pump 416 is operated so that the processing solution in a quantity of 100 milliliters in the processing tank 400 is discharged to the buffer tank 406. Note that the amount of discharge at this time can be detected by both of the accurate level sensor 112 and operation time of the pump 416. The processing solution discharged into the buffer tank 406 and flowed over the buffer tank 406 is, by the overflow pipe 419, discharged into the waste water tank 408.

Then, the pump 412 is operated so that the processing solution (which is a mixture of the processing solution in the buffer tank 406 and the replenisher solution in the replenisher tank 404) in a quantity of 100 milliliters in the preparation tank 402 is replenished to the processing tank 400. The amount of the discharge can be detected by both of the accurate level sensor 112 and the operation time of the pump 412.

Since the apparent amount of the replenisher solution is 10 times, the processing solution can be replenished with an excellent accuracy.

Since the replenisher solution for ten replenishment operations (diluted by ten times) is stored in the preparation tank 402, the pumps 414 and 418 are again operated after the 10 times of the operation have been completed so that preparation similar to the above-mentioned preparation is performed.

Although the accurate level sensor 112 may be provided for only the processing tank in the above-mentioned system, it is preferable that the accurate level sensor 112 is provided for the processing tank 400, the preparation tank 402, the replenisher tank 404 and the buffer tank 406 if permitted to control the solution level. In this case, the material balance of the processing solution can be controlled with an excellent accuracy and therefore the quality of the processing solution can be maintained.

If the magnification of dilution of the replenisher solution is changed, the replenishment accuracy can, of course, be improved.

The structure according to this embodiment may be combined with the structures according to the foregoing embodiments.

Since the apparent amount of replenishment can be enlarged in this embodiment, the processing solution can be controlled with excellent accuracy.

Although the structure shown in FIG. 9 is arranged such that the processing solution in the processing tank 400 is discharged into the waste water tank 408, the processing solution in the processing tank 400 may be cascaded into another processing tank 400. In this case, the overflow pipe 419 is required to be changed to a pump.

Although this embodiment has the structure such that the pump 418 was employed to discharge the solution to the preparation tank 402, a control valve may be employed in place of the pump 418.

An automatic development unit comprising the control valve will now be described with reference to FIG. 10. The same elements as those of the automatic development unit 10 according to the embodiment shown in FIG. 9 are given the same reference numerals and the same elements are omitted from description.

Figure 10:
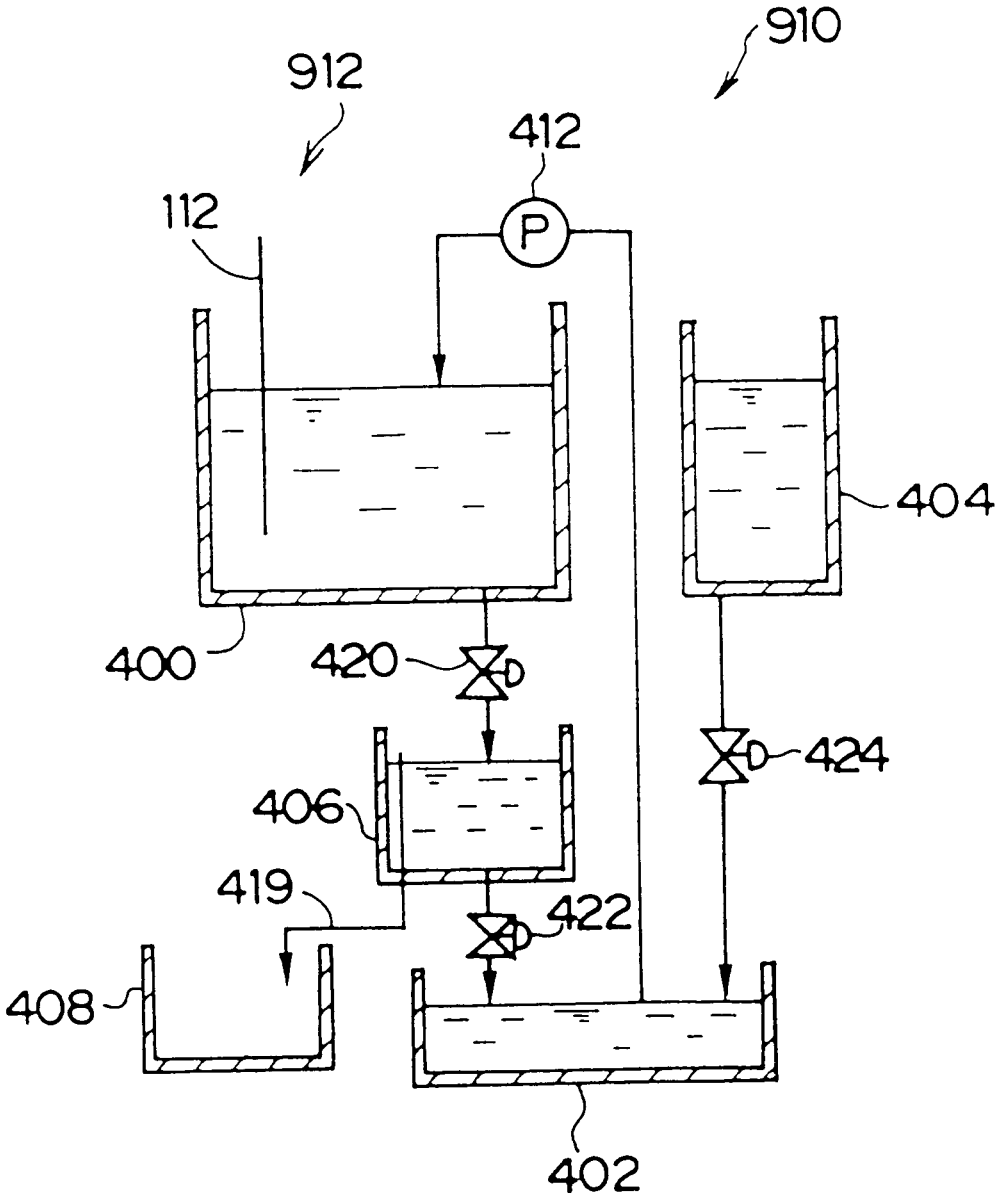
FIG. 10 is a schematic view showing the structure of an automatic development unit according to another embodiment of the present invention.

As shown in FIG. 10, a processing section 912 of the automatic development unit 910 has the buffer tank 406 below the processing tank 400. A preparation tank 402 is disposed below the buffer tank 406. The replenisher tank 404 is disposed above the preparation tank 402. The processing solution in the processing tank 400 is, through the control valve 420, discharged to the buffer tank 406. The processing solution in the buffer tank 406 is discharged to the preparation tank 402 through a control valve 422. The replenisher solution in the replenisher tank 404 is discharged to the preparation tank 402 through a control valve 424.

In this embodiment, the capacity of the buffer tank 406 is set to be 900 milliliters and thus an excess portion of the processing solution is discharged to the waste water tank 408 through an overflow pipe 419.

If the buffer tank 406 is set to have a predetermined capacity required for the preparation, a required amount of diluted solution can be supplied to the preparation tank only by opening the control valve 422. If the replenisher solution is set into a kit (for example, a bottle) for 10 times of replenishment operations (in this case), one kit of the replenisher solution is required to be supplied into the preparation tank 402. In this case, the replenisher tank 404 and the control valve 424 may be omitted from the structure.

In this embodiment, the accuracy of the system depends on only the accuracy of the pump 412 and the accurate level sensor 112 and the apparent amount of replenishment can be enlarged. Therefore, the processing solution can be controlled more accurately.

Although the foregoing embodiments have the structure such that the proportioning pumps and the like are used to measure the processing solution in the processing tank so as to discharge the excess solution, the method is not limited to this. For example, a structure may be employed in which an overflow pipe to which a flow rate sensor is attached is employed to perform discharge while measuring the amount of the solution. In this case, a predetermined amount can be discharged similarly to the proportioning pump.

What is claimed is:

1. A photosensitive material processor, comprising:

discharge means for discharging a processing solution stored in a processing tank;

replenishment means for replenishing a replenisher solution to said processing tank;

processing solution amount acquiring means for acquiring the quantity of the processing solution stored in said processing tank; and water adding means for adding water to said processing tank, wherein said discharge means is able to measure the processing solution to be discharged, and said replenishment means is able to measure the replenisher solution to be replenished.

2. A photosensitive material processor according to claim 1, wherein said discharge means and said replenishment means are structured to be operated in synchronization with each other.

3. A photosensitive material processor according to claim 2, wherein said discharge means and said replenishment means are formed by one pump unit composed of a multiplicity of pumps.

4. A photosensitive material processor according to claim 2, wherein said processing solution amount acquiring means has a solution level sensor for detecting the level of the processing solution in said processing tank, storage means for storing the relationship between the level of the processing solution in said processing tank and the amount of the stored processing solution, and calculating means for calculating the amount of the processing solution in said processing tank in accordance with the level detected by said solution level sensor and said relationship stored in said storage means, wherein area (a) of opening of the cross section of said processing tank in the horizontal direction in a vertical range in which the level of said processing solution must be detected by said solution level sensor is smaller than area (b) of opening of the cross section of said processing tank in the horizontal direction below said vertical range.

5. A photosensitive material processor according to claim 4, wherein said area (a) of opening includes an area of opening through which said photosensitive material is inserted into said processing tank, an area of opening through which said photosensitive material is discharged from said processing tank and an area of opening through which said solution level sensor is introduced into said processing tank.

6. A photosensitive material processor according to claim 4, wherein the relationship between said area (a) of opening and said area (b) of opening is set such that the level is changed 1 mm or more when the amount of the processing solution in said processing tank has been changed by 10 ml.

7. A photosensitive material processor according to claim 1, wherein said discharge means is a first proportioning pump and said replenishment means is a second proportioning pump.

8. A photosensitive material processor according to claim 1, wherein said discharge means is an electromagnetic valve and said replenishment means is a proportioning pump.

9. A photosensitive material processor according to claim 1, wherein said processing solution amount acquiring means has a solution level sensor for detecting the level of the processing solution in said processing tank, storage means for storing the relationship between the level of the processing solution in said processing tank and the amount of the stored processing solution, and calculating means for calculating the amount of the processing solution in said processing tank in accordance with the level detected by said solution level sensor and said relationship stored in said storage means, wherein area (a) of opening of the cross section of said processing tank in the horizontal direction in a vertical range in which the level of said processing solution must be detected by said solution level sensor is smaller than area (b) of opening of the cross section of said processing tank in the horizontal direction below said vertical range.

10. A photosensitive material processor according to claim 9, wherein said area (a) of opening includes an area of opening through which said photosensitive material is inserted into said processing tank, an area of opening through which said photosensitive material is discharged from said processing tank and an area of opening through which said solution level sensor is introduced into said processing tank.

11. A photosensitive material processor according to claim 9, wherein the relationship between said area (a) of opening and said area (b) of opening is set such that the level is changed 1 mm or more when the amount of the processing solution in said processing tank has been changed by 10 ml.

12. A photosensitive material processor according to claim 1 further comprising a temperature sensor for detecting the temperature of an environment around said photosensitive material processor, a humidity sensor for detecting the relative humidity of said environment, and control means for calculating the amount of evaporation of said processing solution from said processing tank and controlling the operation of said water adding means in accordance with the temperature detected by said temperature sensor and relative humidity detected by said humidity sensor.

13. A photosensitive material processor, comprising:

a discharger which discharges a processing solution stored in a processing tank;

a replenisher which replenishes a replenisher solution to said processing tank;

an acquirer which acquires the quantity of the processing solution stored in said processing tank; and an adder which adds water to said processing tank, wherein said discharger is able to measure the processing solution to be discharged, and said replenisher is able to measure the replenisher solution to be replenished.

* * * * *